United States Patent [19]

Lödige et al.

[11] 4,006,706

[45] Feb. 8, 1977

[54] DEVICE FOR APPLYING GLUE TO CHIPS

[76] Inventors: Wilhelm Lödige, Elsener Str. 9c; Fritz Lödige, Leuschnerstr. 12; Josef Lücke, Im Lohfeld 13, all of 4790 Paderborn, Germany

[22] Filed: June 16, 1975

[21] Appl. No.: 587,318

[30] Foreign Application Priority Data

June 14, 1974 Germany ..... 2428588

[52] U.S. Cl. ..... 118/303; 259/10

[51] Int. Cl.[2] ..... B05C 5/00

[58] Field of Search ..... 118/303; 259/9,10

[56] References Cited

UNITED STATES PATENTS 3,163,403 12/1964 Engles ..... 259/9

3,734,471 5/1973 Engles ..... 259/10 X

FOREIGN PATENTS OR APPLICATIONS 722,074 11/1965 Canada ..... 259/10

*Primary Examiner*—Dorsey Newton

*Attorney, Agent, or Firm*—Walter Becker

[57] ABSTRACT

A device for applying glue to chips, fibers or the like particles of cellulose containing substances, such as wood, bagasse, or the like, with an at least approximately cylindrical chamber in which the material to which the glue is to be applied passes through an inlet chute, an inlet zone, a gluing zone following the latter, a post-mixing zone, and an outlet in the form of a ring of material rotating along the cylindrical wall of the chamber, and in which on a shaft extending through the chamber, in the inlet zone there are arranged conveying tools which are provided with a vane or paddle-shaped working surface. Tools are arranged in the gluing zone and post-mixing zone for applying glue to and mixing the material. The device according to the invention is characterized primarily in that in the merging region between the inlet zone and the gluing zone is designed as a ring-building zone to which effect in this region there is arranged a plurality of loosening and drawing-in tools rotating with the shaft which extends through the chamber.

22 Claims, 4 Drawing Figures

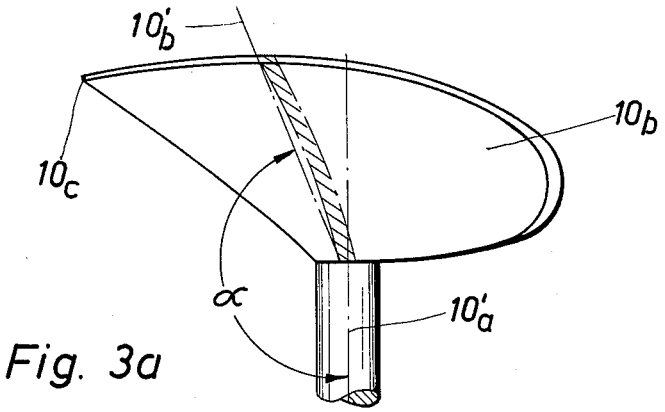
Fig. 3a
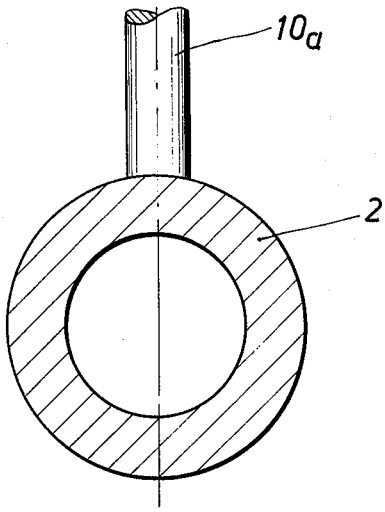
Fig. 3
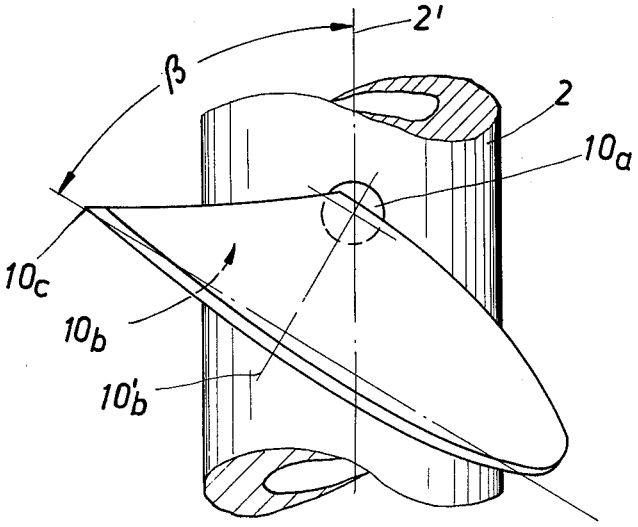

DEVICE FOR APPLYING GLUE TO CHIPS

The present invention relates to an apparatus for applying glue to chips, fibers or similar parts of cellulose containing substances such as wood bagasse, etc., which apparatus has at least an approximately cylindrical chamber in which the material to which glue is to be applied passes through an inlet chute, an inlet zone, a gluing zone following said inlet zone, and through a mixing zone as well as an outlet in the form of a ring of material to be processed which rotates along a chamber wall. More specifically, the present invention relates to an apparatus of the above mentioned type in which on a shaft extending through said chamber in the inlet zone there are provided inlet tools equipped with blade or vane-shaped working surfaces, while in the gluing and mixing zone there are arranged tools for applying glue and/or mixing the material.

With heretofore known glue-applying machines of the above mentioned type, the chips or fibers or similar particles of material are through an inlet passage tangentially leading into said chamber introduced into the machine, said inlet zone being arranged in one end of the horizontally arranged chamber. The said chips, fibers or similar particles of material are caught by a few large conveying tools with large surfaces which conveying tools are arranged in said inlet zone, and are then moved in the direction toward the preferably cylindrical mixing chamber. In the mixing chamber the material is by the tools rotating together with the shaft accelerated in the circumferential direction in such a way that a ring of mixed material forms on the inner wall of the mixing chamber, which ring slides spirally along said wall in the direction toward the outlet. The binding agent, for instance a liquid glue, is added in the gluing zone which is adjacent to the inlet zone, and preferably through a centrifuging pipe which rotates together with the mixing shaft. The liquid glue added in the gluing zone is in the following post-mixing zone uniformly distributed over the particles of various sizes, above all due to the mutual friction of the particles to be mixed, for instance by the friction of chip with chip. This distribution is aided by the relative movement of the mixing tools which plow through the ring of chip material. In the end region of the mixing chamber, the material with the glue applied thereto is preferably passed to an exit passage while an adjustable throttle flap is interposed, and is then withdrawn from said exit passage.

The conveying tools arranged in the inlet zone with their large surface working surfaces of paddle shape are adjusted relative to the central axis of the mixing chamber in such a way that the material will be accelerated toward the outlet side of the mixing chamber as well as radially toward the outside. Together with the material dropping into the inlet chute, also air passes through the inlet chute into the mixing chamber and into the region of action of the tools. Inasmuch as the few conveying tools with large surfaces act like ventilator vanes, the air is at a considerable velocity in a shock-like and strong manner moved or agitated in an undesired way in the inlet zone. The pulsating air current thus generated in the inlet zone and in the mixing chamber may with a low throughout of the engine or with a processing of light mixing material, especially when fiber material is involved, carry along such material so that depending on the property of the material, a fiber or chip material deficiency may extend into the region of the gluing zone along the wall of the mixing chamber. As a result thereof, the formation of the ring of material desired for uniform glue application will be prevented. In addition thereto, the drawback exists that an insufficient quantity of chip or fiber material will be unable sufficiently to wipe off the glue deposited on the wall of the mixing chamber so that in spite of cooling the wall of the drum at such areas of the chamber wall, harmful glue deposits can form with the drawbacks well known under such circumstances. With heretofore known machines it has also been found that an accumulation of the incoming material within the region of the inlet zone occurs below the mounted inlet chute because the tools in the inlet chute will due to their high circumferential speed throw the material too strongly against the inlet flow. Chips and/or fibers accumulate particularly strongly within the region of the edges, corners and surfaces of the chamber cylinder adjacent to the inlet chute. In other words, this accumulation occurs at the area where the inlet chute penetrates the cylindrical chamber against which penetration the chip or fiber material is thrown at high kinetic energy by the large surface-conveying tools provided in the inlet region. As a result thereof, in addition thereto, a considerable wear occurs in the region of the mutual penetration of the inlet chute and circumference of the drum. Due to the accumulation of the material, especially due to the acculation of chip and fiber material, it is possible that as a result of the high-speed rotating tools of the inlet zone, rather disadvantageous squeezing of the material occurs and even a destruction of the chips and fiber structure takes place. These accumulations which occur ahead of the gluing zone prevent the formation of the ring of material which is easy of the chips and fibers and the like and assures a uniform treatment, especially a uniform application of glue to the material as well as its uniform transport.

It is an object of the present invention so to design the above mentioned glue applying device that accumulations of the material within the region of the inlet zone, especially in the mutual region of penetration of inlet and gluing zone, and the inherent drawbacks will be avoided.

It is a further object of the invention so to design a glue applying device as set forth above that the chip and fiber material enters through the inlet chute well within the region directly ahead of the entrance into the gluing zone be loosened without damage to its structure and will uniformly be distributed over the circumference so that already prior to the entry into the gluing zone the material will be pre-shaped to an optimum uniformly strong and uniformly dense ring of material which will then after entering the gluing zone be uniformly subjected to a binding agent and will be conveyed further by the there provided tools.

These and other objects and advantages of the invention will appear more clearly from the following specification in connection with the accompanying drawings, in which:

FIG. 3 is a top view of a dissolving and intake vane.

Figures 1, 2:
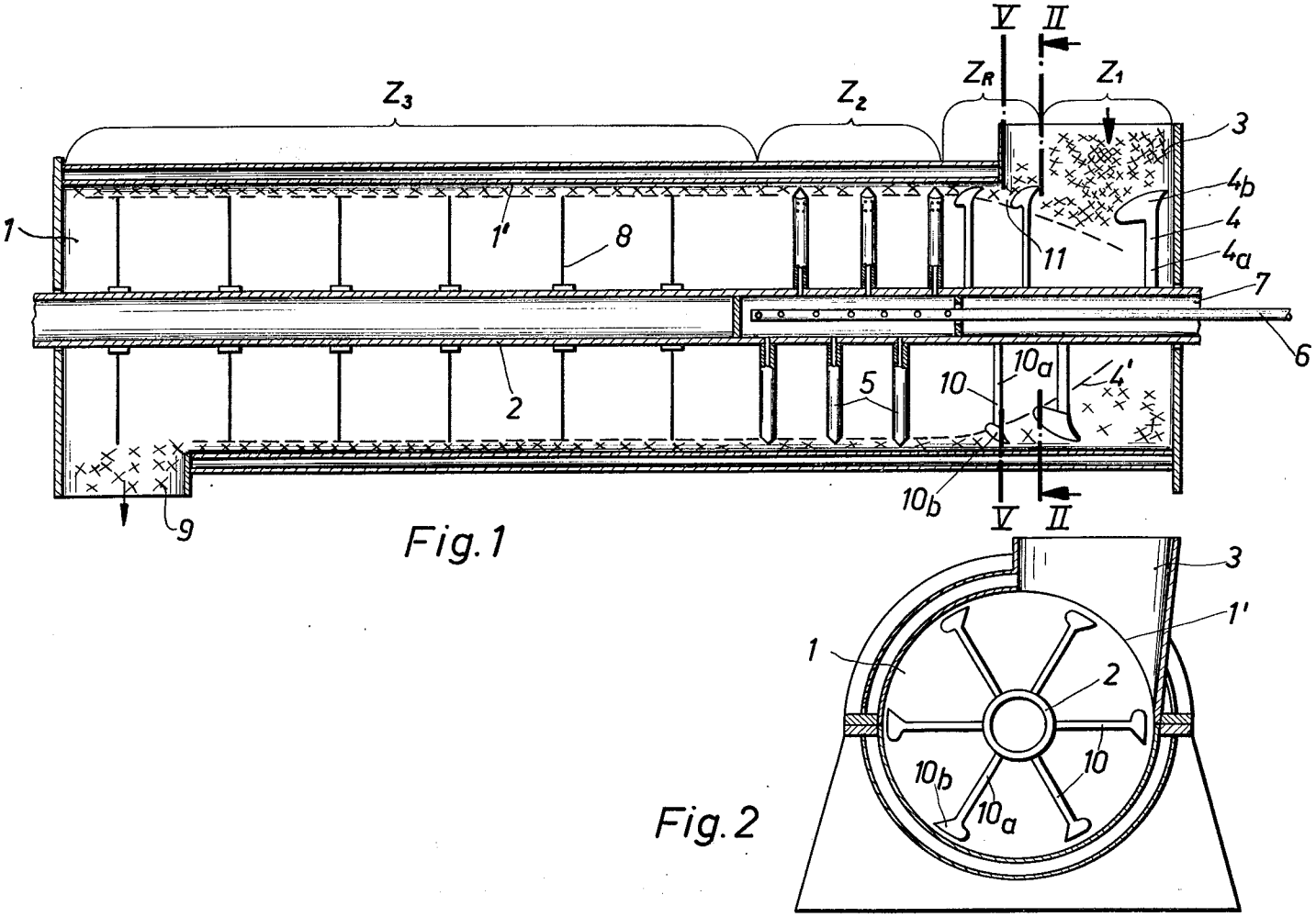
FIG. 1 is a longitudinal section through the glue-applying device according to the invention.
FIG. 2 is a section taken along the line II—II of FIG. 1.

FIG. 3*a* is a side view of the vane of FIG. 3.

The device according to the present invention is characterized primarily in that the merging region between the inlet zone and the gluing zone is designed as a ring-forming zone by providing in said region a plurality of loosening and drawing-in-tools rotating together with the shaft extending through the chamber forming part of the device.

This ring-forming zone comprises about the axial region in the last third of the inlet chute as well as the axial region which is adjacent thereto which follows in the direction toward the outlet of the mixing chamber, said axial region being located between the mutual penetration line of the inlet chute and the circumference of the drum and the start of the gluing zone. For purposes of forming the chip or fiber material ring within this ring-forming zone located ahead of the gluing zone, it is suggested according to a further development of the invention to provide approximately on the shaft from 4 to 12 loosening and/or drawing-in tools, preferably uniformly offset in axial and/or circumferential direction. Preferably, an offsetting of the tools with regard to each other is effected according to which at least one part of the loosening and/or drawing-in tools which are arranged adjacent to each other are in the manner of a helix distributed over the circumference of the shaft. In this way, a particularly good loosening-up of the material introduced through the inlet chute and its uniform formation to an optimum ring of material is obtained if after a further feature of the invention all loosening and/or drawing-in tools are divided into at least two groups, each group being distributed along a helix over the circumference of the shaft. The gluing zone will then in its full structural length be uniformly well taken advantage of so that the degree of efficiency of the bluing tools becomes obvious inasmuch as already due to the design according to the invention of the ring-forming zone, fully formed ring of material reaches the gluing zone.

Referring now to the drawings in detail, the gluing device according to the invention has a longitudinally extended horizontally arranged cylindrical chamber 1 along the axis of which a mixing shaft 2 is rotatably journalled. At the inlet side of the chamber there is provided an inlet chute 3 through which the material to be mixed such as fibers, chips or the like, is introduced from above. The material passes into the inlet zone Z1 in which relatively few conveying tools 4, 4' are provided which comprise a tool shank 4a and vane-shaped working surfaces 4b with a large surface. Instead of these few for instance 1, 2 or 3 large surface conveying tools 4, 4', also a corresponding number of tools with smaller vane-shaped working surfaces may be provided. The vane-shaped working surfaces *4b* of these conveying tools 4, 4' are so designed and inclined that they will grasp the material which substantially tangentially drops in from above and transport said material to the cylindrical chamber 1 in a direction axially with regard to shaft 2. The inlet chute 3 merges at the penetration cross section indicated by the lines V—V in FIG. 1 with the cylindrical wall 1' of chamber 1. In the gluing zone Z2 there are provided gluing tools 5, for instance in the form of centrifuging tubes arranged on shaft 2. These tubes are fed with liquid glue through a central feeding pipe 6 which extends into the hollow part 7 of shaft 2. The gluing zone Z2 is followed by a post-mixing zone Z3 in which mixing tools 8 rotate together with shaft 2. At the end of the mixing zone Z3 there is located the outlet 9.

In conformity with the present invention, the merging region between the inlet zone Z1 and the glue-applying zone Z2 is designed as ring forming zone ZR. It is in this zone that a greater number of loosening and drawing-in tools 10 is provided which tools rotate together with shaft 2. This ring-forming zone comprises the axial region in the last third of the inlet chute as well as the axial region which follows in the direction toward the outlet 9 of the mixing chamber 1 and which is located behind the penetration cross section V—V between the inlet chute 3 and the inlet cross section of mixing chamber 1. In this ring-forming zone Z4 there are located from about four to twelve loosening and drawing-in tools 10 (in the specific embodiment shown, six loosening and drawing-in tools 10) which are evenly spaced in axial direction of shaft 2 and when viewed in circumferential direction have uniform angular distances from each other. The loosening and drawing-in tools 10 are further preferably helically arranged over the circumference of shaft 2. Either all tools 10 may be located on a single helix or the tools may be arranged in groups, for instance in two or three groups, each having two or three individual tools so that each group alone will form a portion of a helix while all groups together form a double or triple winding helix. Due to this helical arrangement of the loosening and drawing-in tools, a particularly satisfactory loosening and drawing-in effect is obtained with regard to the chip and fiber material conveyed to these tools. The tools 10 consist primarily of a tool shank **10*a* and a working surface 10*b*. The sickle or vane-shaped working surface 10*b* is preferably radially adjustable relative to the shank 10 which means toward the wall 1' of the chamber. At the same time there is obtained an adjusting possibility of the working surface 10*b* about the longitudinal axis of shank 10*a*** for obtaining an optimum loosening and drawing-in effect for the respective type of material.

Due to the multiplicity of the loosening and drawing-in tools 10 provided in the ring-forming zone ZR according to the invention, the chip and fiber material conveyed from the inlet zone Z1 through the there provided conveying tools 4, 4' in the direction toward the chamber 1 is at short intervals caught by the relatively closely adjacent tools 10. The relatively great oncoming quantity of chip or fiber material is due to the multiplicity of the provided drawing-in or loosening tools 10 equalized so that piles or lumps of fibers will due to the tearing effect of these tools 10 be loosened up and simultaneously the thus loosened up chip or fiber material is passed into intimate rotational contact with the tools 10 in such a way that already ahead of the gluing tools proper 5 a uniformly built up ring of chip or fiber material will be formed. FIG. 1 shows diagrammatically by cross marks the fiber material dropping into the inlet chute. Similarly, FIG. 1 shows the loosening-up of said fiber material and the subsequent formation of the ring 11. The formation of such chip or fiber ring in front of the gluing zone proper is of particular advantage in connection with the gluing of fiber material because such light fiber material is neither accumulated in the inlet zone nor can it be carried away in an uncontrolled and non-uniform manner by air currents deep into the gluing zone, whereby a non-uniform gluing and a formation of agglomeration would occur in the gluing zone. Due to the multiplicity of the tools 10 provided in the zone ZR, the oncoming fiber material is in fast succession caught by the individual tools 10 and is conveyed in axial direction. Simultaneously therewith due to the multiplicity of the tools 10, nonuniform impulse-like non-controllable air currents are avoided which heretofore have interfered with the building up of a ring of material. Thus, already in the ring-forming zone ZR, a uniformly strong and uniformly dense rotating ring of material is built up which is conveyed to the first gluing tools 5 of the gluing zone Z2 and here is immediately uniformly provided with liquid glue leaving the centrifuging tubes 5.

Experience has shown that when fiber material is employed, a particularly uniform ring formation occurs in the zone ZR when at least one of the loosening-up or drawing-in tools 10 is at least half as great as the working surface of at least one conveying tool 4, 4' provided in the inlet zone Z1. In this connection, optimum conditions are obtained when preferably the working surfaces 10*b* are approximately from 0.2 to 0.3 times as great as the working surfaces 4*b* of the drawing-in tools 4.

The total of the working surface 10*b* of all loosening up and drawing-in tools 10 should be equal or less than the total of the working surfaces 4b of the conveying tools 4, 4'.

In order to realize an optimum loosening-up of the material, especially when fibers are involved, by the working surfaces 10*b* of the tools 10, advantageously the working surfaces 10*b* of the tools 10 of the ring-forming zone Z and/or the inlet zone Z1 are designed in the form of a vane or a sickle and more specifically preferably in such a way that the conveying surfaces when viewed in the direction of rotation have a forwardly pointing taper which ends in a tip 10*c*. This tip 10*c* forms that part of the working surface 10*b* which is located radially farthest outwardly and bring about that for instance when fiber lumps have formed, the individual fibers or bundles of fibers are caught by said tips so that the fiber quantities arriving in the form of piles or lumps will be loosened up. It is advantageous when the drawing-in and loosening-up tools of the ring-forming zone ZR and/or the tools 10 of the inlet zone Z1 have approximately the same radial length as the tool of the gluing zone Z2.

Experience has shown that particularly good loosening-up and drawing-in effects are realized when the vane surface of at least one preferably all tools 10 of the ring-forming zone ZR confined with the axis of the tool shank 10 an angle $\alpha$ of from 120°–160° preferably 140° (see FIG. 3*a*) while one leg 10'*a* forms the ideal axis 10'*a* and the other leg 10'b forms the center line of the effective working surface 10*b*. FIG. 3 further shows the angle $\beta$ one leg 2' of which is parallel to the central axis of shaft 2 while the other leg 10'*b* forms the central line of the working surface 10*b*. This angle $\beta$ thus reflects the magnitude of the adjusting position of the working surface 10b when rotating the vane surface 10b about the axis 10'a. The angle $\beta$ thus indicates the rotary adjusting position of the vane surface 10*b* in the direction toward the axis 10'a of leg 10*a*. The more acute this angle, the more chips are withdrawn by the vane surface 10*b* from the oncoming quantity of chip material. Favorable conditions have been realized when in the ring-forming zone ZR there are arranged at least twice as many loosening-up and drawing-in tools 10 as there are arranged in the inlet zone Z1. The fiber or chip material ring which is formed in the zone ZR by the first gluing tool 5 of the gluing Z2 is subsequently uniformly conveyed to the tools 5 of the gluing zone and then passes into the post mixing zone Z3 proper in which the mixing tools 8 are provided. After passing through the mixing zone Z3, the glued drip or fiber material passes through the outlet 9 from the mixing chamber. Said outlet 9 may in a suitable manner be provided with throttle means, for instance a throttle flap. With the arrangement of such throttling device, the degree of filling and thus the degree of strength of the ring of material which passes through the mixing chamber 1 can in conformity with the requirement inherent to the individual situation, especially in conformity with the through-put, be selected in conformity with the material to be glued, namely, chips, fibers, etc.

As will be evident from FIG. 3, the working surfaces 10b of the tools in the ring-forming zone ZR and/or the working surfaces of the inlet zone Z1 are arched and preferably in such a way that the concave side of the arc points at least partially in the direction toward the gluing zone Z2. As a result thereof, in addition to a favorable loosening-up of the material, a particularly advantageous drawing-in effect in the direction toward the gluing zone will be realized.

It is, of course, to be understood that the present invention is, by no means, limited to the specific showing in the drawings, but also comprises any modifications within the scope of the appended claims.

What we claim is:

1. An apparatus for applying glue to chips, fibers, and similar parts of cellulose containing substances such as wood and bagasse, which includes: an at least approximately cylindrical chamber comprising an inlet chute at one of its ends and an outlet at its other end and when viewing from said inlet chute toward said outlet also comprising successively an inlet zone and a ring forming zone and a gluing zone, and a post-mixing zone, a rotatable shaft longitudinally extending within said chamber from said inlet zone to said other chamber end, conveyor tool means arranged within said inlet zone and keyed to said shaft for rotation therewith, said ring forming zone being formed by the transition between said inlet zone and said gluing zone, a plurality of glue applying tools arranged within said gluing zone and connected to said shaft for rotation therewith while extending from said shaft in the direction toward the inner peripheral surface of said chamber, loosening-up and drawing-in tools connected to said shaft for rotation therewith and arranged in said ring forming zone while extending from said shaft toward the inner periphery of said chamber, and post-mixing tools connected to said shaft in axially spaced relationship to each other within said post-mixing zone, the latter extending from said gluing zone to said other end of said chamber, the working surface of said loosening-up and drawing-in tools in said ring forming zone having a tapering decreasing working surface ending in a tip, the tip of said working surface forming the radially farthest outward portion of said working surface.

2. An apparatus according to claim 1, in which said ring forming zone comprises about the axial region of the last third of said inlet chute as well as the axial region nearest thereto in the direction toward said outlet of said mixing chamber, said last mentioned axial region being located ahead of said gluing zone and behind the cross section of penetration of said inlet chute with said chamber.

3. An apparatus according to claim 1, in which said ring forming zone extends at least one-third into said inlet chute and into said chamber.

4. An apparatus according to claim 1, in which about from four to twelve loosening-up and drawing-in tools are arranged within said ring forming zone.

5. An apparatus according to claim 4, in which said loosening-up and drawing-in tools are uniformly offset relative to each other in the axial direction of said shaft.

6. An apparatus according to claim 4, in which said loosening-up and drawing-in tools are uniformly offset relative to each other in the circumferential direction of said shaft.

7. An apparatus according to claim 1, in which at least a number of said loosening-up and drawing-in tools are arranged along a helix around said shaft.

8. An apparatus according to claim 1, in which all of said loosening-up and drawing-in tools are divided into at least two groups, each of said loosening-up and drawing-in tools being distributed along a helix about said shaft.

9. An apparatus according to claim 1, in which the tip of said loosening-up and drawing-in tools points in the direction of rotation of said shaft.

10. An apparatus according to claim 1, in which the working surface of at least one of said loosening-up and drawing-in tools in the ring forming zone is arched.

11. An apparatus according to claim 10, in which the working surface of at least one of the tools in said ring forming zone is so arched that the concave side of the arched portion points at least partially toward the gluing zone.

12. An apparatus according to claim 1, in which at least some of said loosening-up and drawing-in tools are arranged in transition range between said inlet zone and said ring forming zone.

13. An apparatus according to claim 12, in which the working surface of at least one of said loosening-up and drawing-in tools in said is so arched that the concave side of the arched portion points at least partially toward the gluing zone.

14. An apparatus according to claim 1, in which said loosening-up and drawing-in tools in said ring-forming zone have about the same radial length as the glue applying tools in said gluing zone.

15. An apparatus according to claim 1, in which the tools in said inlet zone have about the same radial length as the glue applying tools in said gluing zone.

16. An apparatus according to claim 1, in which the working surface of at least one of the tools in said ring forming zone forms with the shank axis of said at least one tool an angle $\alpha$ of from 120° to 160°.

17. An apparatus according to claim 16, in which said angle $\alpha$ equals about 140°.

18. An apparatus for applying glue to chips, fibers, and similar parts of cellulose containing substances such as wood and bagasse, which includes: an at least approximately cylindrical chamber comprising an inlet chute at one of its ends and an outlet at its other end and when viewing from said inlet chute toward said outlet also comprising successively an inlet zone and a ring forming zone and a gluing zone, and a post-mixing zone, a rotatable shaft longitudinally extending within said chamber from said inlet zone to said other chamber end, conveyor tool means arranged within said inlet zone and keyed to said shaft for rotation therewith, said ring forming zone being formed by the transition between said inlet zone and said gluing zone, a plurality of glue applying tools arranged within said gluing zone and connected to said shaft for rotation therewith while extending from said shaft in the direction toward the inner peripheral surface of said chamber, looseing-up and drawing-in tools connected to said shaft for rotation therewith and arranged in said ring forming zone while extending from said shaft toward the inner periphery of said chamber, and post-mixing tools connected to said shaft in axially spaced relationship to each other within said post-mixing zone, the latter extending from said gluing zone to said other end of said chamber, the working surface of said loosening-up and drawing-in tools in said inlet zone being vane-shaped and having a tapering decreasing working surface ending in a tip, said tip forming the radially farthest outward portion of said working surface.

19. An apparatus according to claim 18, in which the total of the working surfaces of all loosen-up and drawing-in tools does not exceed the total of the working surfaces of said conveying tool means.

20. An apparatus according to claim 18, in which the working surface of at least one of said loosening-up and drawing-in tools is at a maximum half as great as the working surface of a conveyor tool means in said inlet zone.

21. An apparatus according to claim 20, in which the working surface of at least one of said loosening-up and drawing-in tools if from 0.2 to 0.3 as large as the working surface of a conveyor tool means located in said inlet zone.

22. An apparatus according to claim 18, in which the number of conveyor tool means in said ring forming zone is at least twice that of said inlet zone.

* * * * *